US005215484A

United States Patent [19]

Saito

[11] Patent Number: 5,215,484

[45] Date of Patent: Jun. 1, 1993

[54] TILT UP DEVICE FOR OUTBOARD MOTOR

[75] Inventor: Hideki Saito, Kakegawa, Japan

[73] Assignee: Yamaha Hatsudoki Kabushiki Kaisha, Iwata, Japan

[21] Appl. No.: 783,546

[22] Filed: Oct. 28, 1991

[30] Foreign Application Priority Data

Oct. 24, 1990 [JP] Japan ..... 2-286849

[51] Int. Cl.[5] ..... B63H 21/26

[52] U.S. Cl. ..... 440/61

[58] Field of Search ..... 440/53, 61, 62, 63, 440/113, 900

[56] References Cited

U.S. PATENT DOCUMENTS 4,325,700 4/1982 Kern et al. ..... 440/61
4,551,104 11/1985 Iwashita et al. ..... 440/61
4,605,377 8/1986 Wenstadt ..... 440/61
4,702,714 10/1987 Nakase ..... 440/61
4,781,631 11/1988 Uchida et al. ..... 440/61
4,784,625 11/1988 Nakahama ..... 440/61

*Primary Examiner*—Joseph F. Peters, Jr.
*Assistant Examiner*—Stephen P. Avila
*Attorney, Agent, or Firm*—Ernest A. Beutler

[57] ABSTRACT

A hydraulically operated tilt and trim system for a marine outboard drive including a reservoir for containing make-up fluid for the hydraulic system. The reservoir communicates with the hydraulic system through a conduit in which a pair of oppositely acting check valves are positioned so that gas over the liquid can not enter the fluid system even if the unit is displaced from its normal operation. In addition, the unit is mounted between the mounting brackets of the outboard drive so as to be protected thereby.

32 Claims, 5 Drawing Sheets

TILT UP DEVICE FOR OUTBOARD MOTOR

BACKGROUND OF THE INVENTION

This invention relates to a tilt-up device for an outboard motor and more particularly to improved hydraulic arrangement for controlling the trim condition of a marine outboard drive and a method of mounting and configuring such a unit.

It is well known to provide a hydraulic assembly between the outboard drive portion of a marine propulsion unit and the transom of the watercraft for controlling the trim and tilt movement of the outboard drive. These types of hydraulic systems are well known both in connection with outboard motors and with the outboard drive portion of an inboard/outboard drive. Generally the hydraulic unit has a pair of chambers between which fluid moves in response to changes in trim condition. Normally a reciprocating type of device is used for this purpose and because of the connection of the piston rod to either the outboard drive or the hull of the watercraft, there is a difference in volume transfer for a given degree of movement. This different volume transfer is a result of the area displaced in one of the hydraulic chambers by the piston rod.

It is, therefore, a normal practice to employ a hydraulic reservoir for accommodating these volume changes. Normally the reservoir has a volume of gas over the hydraulic fluid in the reservoir so as to accommodate varying volumes of hydraulic fluid in the reservoir. Although these devices are effective, there is a danger that the gas in the reservoir can enter into the hydraulic system and render its operation unsatisfactory. This has been avoided either by providing a impermeable barrier between the fluid in the reservoir and the gas over the fluid or by mounting the unit in such a way that the gas will tend to self purge itself and return to the area above the liquid in the reservoir. However, this type of unit is frequently transported from place to place and the reservoir may not always be positioned so that the gas will be above the fluid in the reservoir. For example, if the hydraulic assembly is part of an outboard motor, the outboard motor may be moved from boat to boat and gas can become entrapped in the system.

It is, therefore, a principal object to this invention to provide an improved hydraulic unit for a marine outboard drive.

It is a further object to this invention to provide a hydraulic unit for a marine outboard drive wherein gas in the hydraulic system can not enter into the hydraulic unit even if the assembly is tilted to positions other than that in which the unit is designed to normally operate.

It is a further object to this invention to provide an improved reservoir arrangement for the hydraulic system of a marine outboard drive.

In conjunction with devices of the type previously mentioned, it is also common practice to provide a fluid pump that provides fluid to the hydraulic unit so that the tilt and trim condition of the marine outboard drive may be adjusted. At least a portion of such units are normally mounted on the outside of the transom of the watercraft. In fact, there are certain advantages in mounting the complete hydraulic assembly to the rear of the transom of the watercraft so as to minimize the use of piping and conduits. However, where this is done then the hydraulic unit can be exposed to damage.

It is, therefore, a still further object to this invention to provide an improved hydraulic unit for a marine outboard drive wherein all of the components of the hydraulic unit are mounted aft of the transom but are protected from damage by the basic components of the outboard drive.

SUMMARY OF THE INVENTION

A first feature of this invention is adapted to be embodied in a hydraulic arrangement for controlling the trim condition of a marine outboard drive. The hydraulic arrangement includes a hydraulic unit adapted to be interposed between the outboard drive and an associated watercraft for controlling the trim of the outboard drive. The hydraulic unit has a pair of chambers between which fluid passes upon trim changes. A hydraulic reservoir is adapted to contain a fluid for the hydraulic unit and a gas above the level of fluid in the reservoir for accommodating varying volumes of fluid in the reservoir. Conduit means connect the reservoir with the hydraulic unit for flow therebetween. A pair of oppositely acting check valves are provided in the conduit means for permitting fluid flow under pressure through the conduit means while precluding air flow from the reservoir to the hydraulic unit.

Another feature of the invention is adapted to be embodied in a marine outboard drive mounted for movement relative to the transom of an associated watercraft by means of a pair of spaced apart transom brackets. Disposed between these transom brackets is a hydraulic unit including a trim cylinder that has a pivotal connection to the marine outboard drive and the transom bracket at its opposite ends and a pair of trim cylinders, disposed between said brackets and on opposite sides of the tilt cylinder and having housing portions carried by the brackets. The trim cylinders have pistons that are engaged with the marine outboard drive for varying its position. A reversible electric motor and hydraulic pump driven thereby is mounted between one of the transom brackets and the tilt cylinder for supplying fluid under pressure to the cylinders.

DETAILED DESCRIPTION OF THE PREFERRED EMBODIMENT OF THE INVENTION

Figure 1:
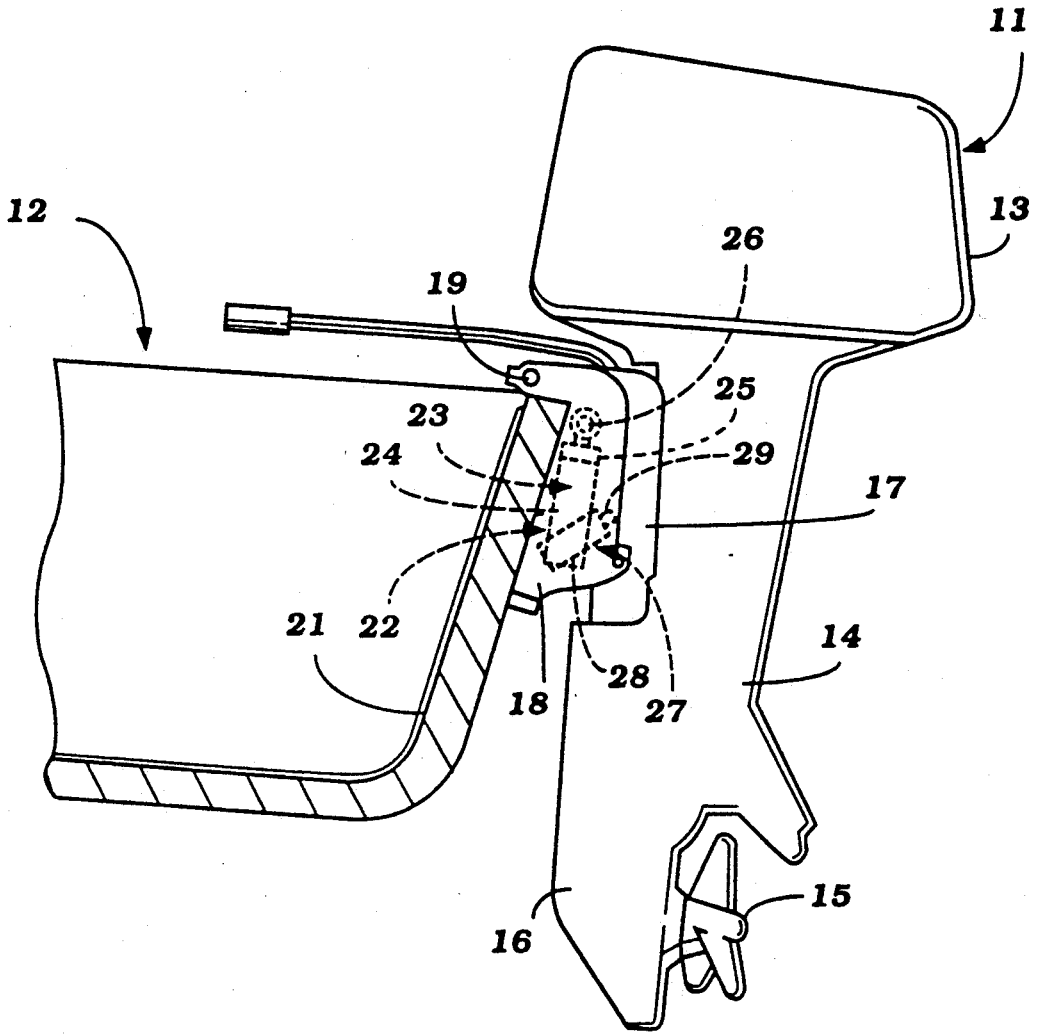
FIG. 1 is a side elevational view of a marine outboard drive as attached to the transom of an associated watercraft, shown partially and in section and which marine outboard drive is constructed in accordance with an embodiment of the invention.

Referring first in detail to FIG. 1, a marine outboard drive in the form of an outboard motor is indicated generally by the reference numeral 11 and is attached, in a manner to be described, to the transom of a watercraft hull 12, shown partially and in cross section. Although the invention is described in conjunction with an outboard motor, it should be readily apparent to those skilled in the art that certain facets of the invention may be employed with the outboard drive unit of an inboard/outboard drive.

The outboard motor 11 includes a power head 13 that contains a powering internal combustion engine and a surrounding protecting cowling, which are not shown in detail since their construction is not important to the invention. The internal combustion engine drives a drive shaft (not shown) that rotates about a vertically extending axis and which is supported within a drive shaft housing 14. This drive shaft drives a propulsion device in the form of a propeller 15 through a conventional forward, neutral, reverse transmission (not shown) in a lower unit 16 positioned at the bottom of the drive shaft housing 14.

A steering shaft (not shown) is affixed to the drive shaft housing 14 and is supported for steering movement about a generally vertically extending steering axis within a swivel bracket 17. The swivel bracket 17 is, in turn, pivotally connected to a clamping bracket, indicated generally by the reference numeral 18, by means of a horizontally disposed tilt pin 19. The clamping bracket 18 is connected to a transom 21 of the watercraft hull 12 in a manner which will be described. A hydraulic unit, indicated generally by the reference numeral 22 is interposed between the hull 12 and the outboard motor 11 and specifically its swivel bracket 17 for controlling the trim and tilt up condition of the outboard motor 11.

The hydraulic assembly 22 includes a tilt cylinder assembly 23 having a cylinder portion 24 that is pivotally connected at its lower ends to the clamping bracket 18 and which defines an internal chamber in which a piston is reciprocately supported and which piston is connected to a piston rod 25 that has a pivotal connection 26 to the swivel bracket 17. The tilt fluid motor 23 is designed primarily to achieve a rapid tilt up of the outboard motor 11 from an operative position as shown in FIG. 1 to an out-of-the water position.

Disposed on opposite sides of tilt fluid motor 23 are a pair of trim fluid motors 27 that have their cylinders 28 affixed to the clamping bracket 18 and piston rods 29 that are engaged with the swivel bracket 17. The trim motors 27 are designed to provide relatively high forces but have a relatively short stroke for achieving trim adjustment of the outboard motor 11 when operating under full power.

Figure 2:
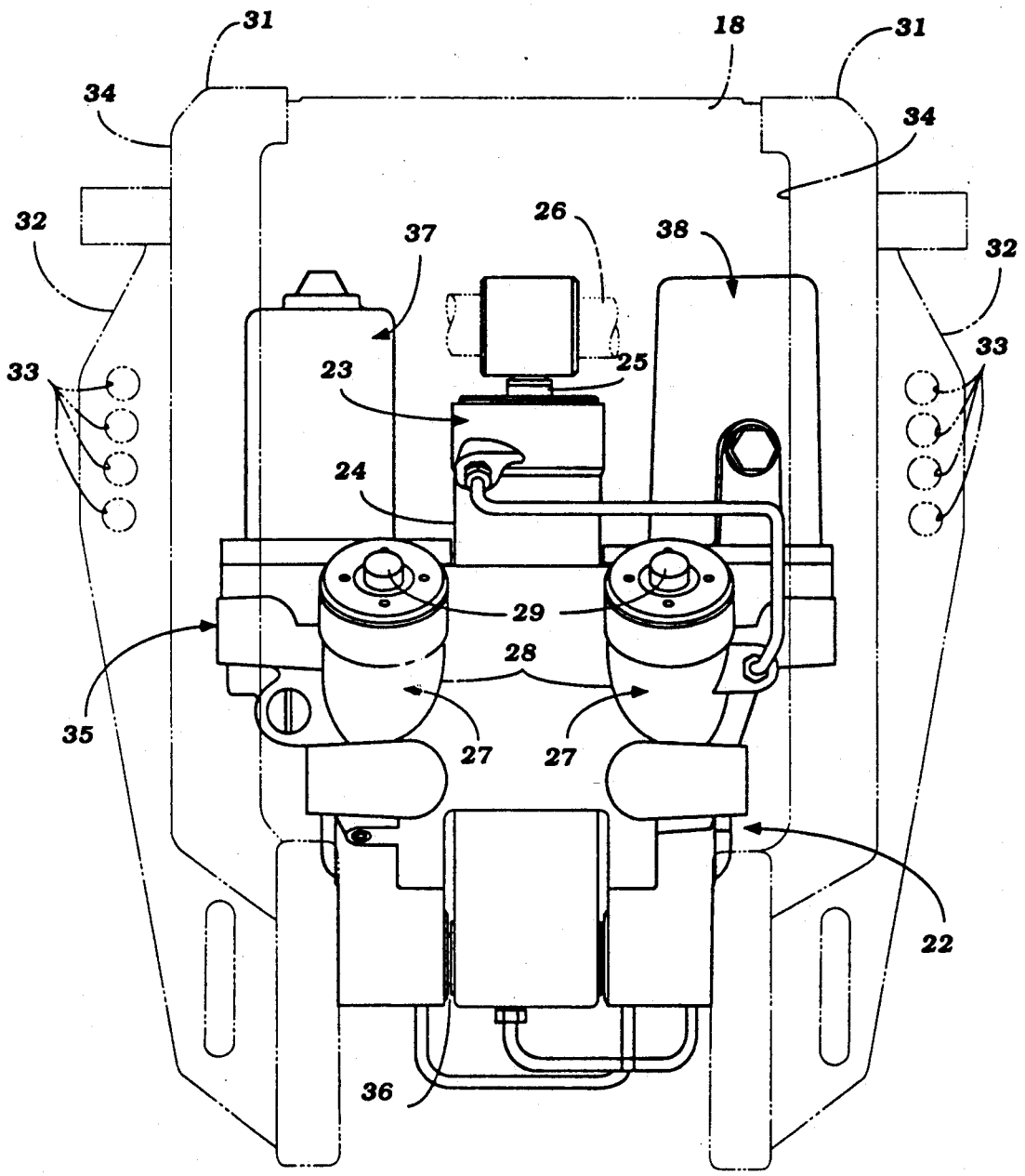
FIG. 2 is an enlarged rear elevational view of the hydraulic assembly with the outboard drive unit removed and the mounting brackets shown in phantom.

Referring now to the remaining figures and initially primarily to FIG. 2, it will be noted that the clamping bracket 18 is actually comprised of two spaced apart side brackets, indicated by the reference numerals 31 that have a generally L-shape configuration with back legs 32 that are appetured as at 33 for attachment to the rear side of the hull transom 21. Outstanding legs 34 of these brackets 31 extend generally rearwardly and define a recessed area between which the hydraulic mechanism 22 is contained as clearly shown in FIG. 2.

This hydraulic mechanism 22 includes a mounting base assembly, indicated generally by the reference numeral 35 that provides a lower pivotal connection 36 to the cylinder 24 of the tilt fluid motor 23. In addition, the cylinders 28 of the trim fluid motors 27 are affixed to this bracket 35 on opposite sides of the tilt fluid motor 23. Also, an electric motor, indicated generally by the reference numeral 37 is mounted on one side of the mounting 35 between the tilt fluid motor 23 and one of the brackets 31. As will be described, this electric motor 37 drives a reversible pump for supplying pressure to the hydraulic assembly 22. A hydraulic reservoir 38 is mounted on the opposite side of the mounting base 35 between the other side of the tilt fluid motor 23 and the remaining bracket 34. As a result, the entire hydraulic assembly 22 will be contained between the sides of the brackets 31 and specifically their legs 34 and protected thereby. At its forward end, the hydraulic assembly is nested or protected by the transom 22 and the rear side is protected by the outboard drive 11.

Figure 4:
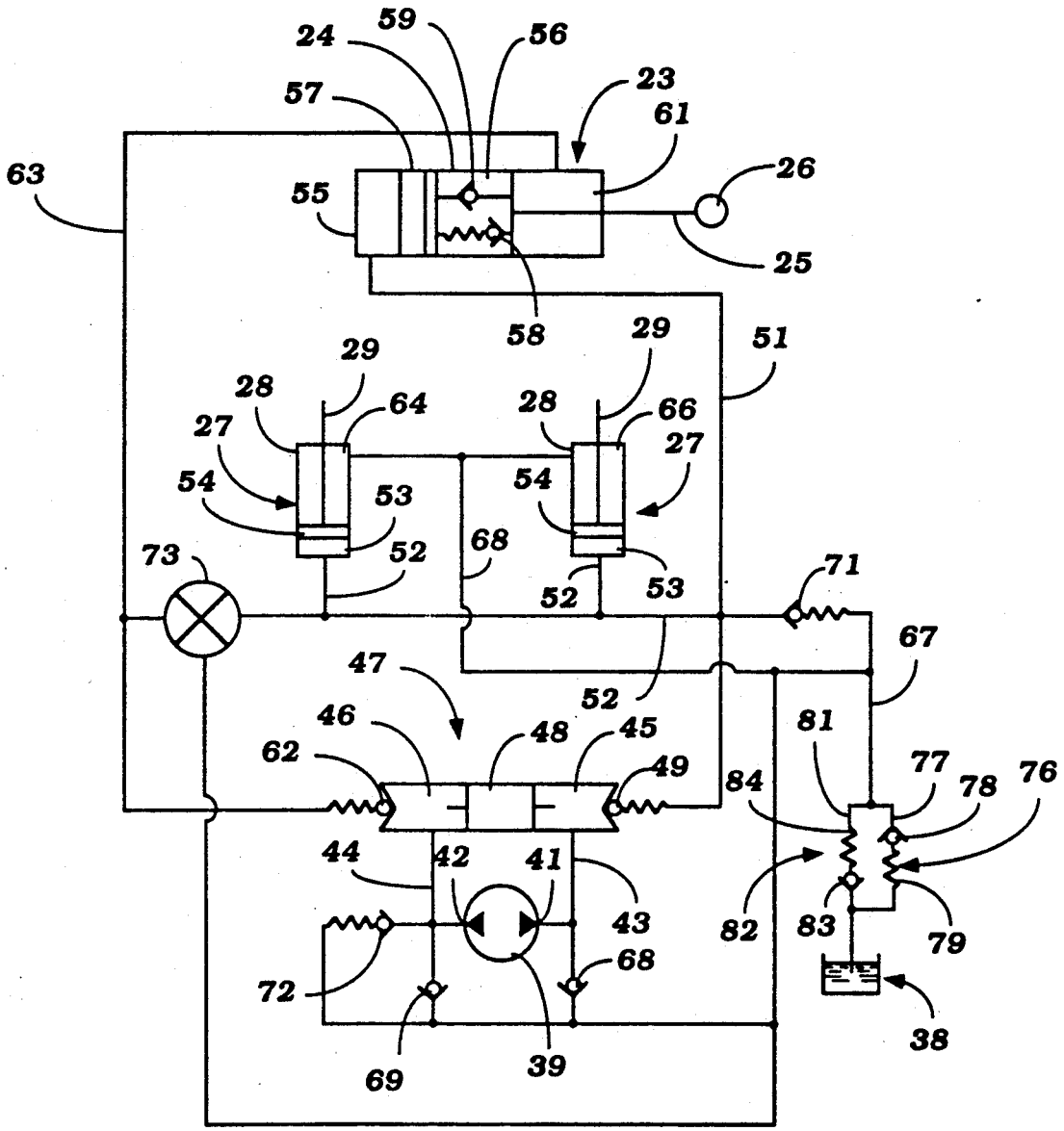
FIG. 4 is a schematic hydraulic diagram of the unit.

The hydraulic circuit by which the cylinders 23 and 27 are actuated is shown schematically in FIG. 4 and includes the aforementioned reversible fluid pump, indicated by the reference numeral 39 which is driven by the electric motor 37 which does not appear in this figure. The pump 39 has a pair of ports 41 and 42 that communicate with conduits 43 and 44, respectively. The conduits 43 and 44 communicate with opposing chambers 45 and 46 of a shuttle valve assembly, indicated generally by the reference numeral 47. A shuttle piston 48 is contained within the shuttle valve assembly 47 and defines the chambers 45 and 46.

The chamber 45 communicates through a check valve 49 with a conduit 51 which has branch portions 52 that extend to trim-up chambers 53 of the trim fluid motors 27. The chambers 53 are formed below pistons 54 that are slideably supported in the cylinders 28 of these trim fluid motors 27. In addition, the passage 51 communicates with a tilt up chamber 55 of the tilt fluid motor 23 which chamber is defined by the tilt piston 56 slideably supported within the cylinder assembly 24 and connected to the aforenoted piston rod 25. In addition, a floating piston 57 is abbuttedly engaged with the piston 56 so as to provide the final determination of the chamber 55.

A shock absorber valve 58 and relief valve 59 oppositely act in the piston 56 so as to permit alternate flow from a chamber 61 formed on the piston rod side of the piston 56 and the area between the floating piston 57 and the tilt piston 56 for shock absorbing tilt-up operation of the outboard motor 11 and return of it, as is well known in this art.

The shuttle valve chamber 46 communicates via a check valve 62 with a tilt-down line 63 that extends to the tilt cylinder chamber 61.

The trim cylinders 27 have return or trim-down chambers 64 formed on the piston rod side of the pistons 54 and which communicate with a sump or reservoir return line 67 through a conduit 68. This reservoir line 67 also communicates with the pump ports 41 and 42 and specifically the conduits 43 and 44 through check valve passages 68 and 69, respectively, so as to permit make-up fluid to be drawn into the pump assembly 39 during its operation.

A tilt-up pressure relief valve 71 is formed in a passageway that communicates with the tilt-up line 51 with the reservoir line 67 and a tilt-trim down pressure relief check valve 72 communicates the pump line 44 with the return line 67.

The operation of the hydraulic circuit will now be described by particular reference to FIG. 4. During tilt and trim-up operation, the electric motor 37 is operated so as to drive the fluid pump 39 in a direction that the port 41 acts as the pressure port and the port 42 acts as the return port. Fluid under pressure will then flow into the conduit 43 and pressurize the shuttle valve chamber 45 sufficiently to underseat the check valve 49. Fluid then flows under pressure into the conduit 51 and through the conduits 52 to the trim piston chambers 53 so as to cause the trim pistons 54 to move outwardly and urge their piston rods 29 into engagement with the swivel bracket 17 to trim-up the outboard motor 11. At the same time, the tilt cylinder chamber 55 will be pressurized so as to move the floating piston 57 and tilt piston 56 along with the tilting movement of the outboard motor 11.

During the tilt-up operation, fluid is returned from the tilt cylinder chambers 64 and 66 through the line 68 to the reservoir return line 67. Also, the pressurization of the shuttle valve chamber 45 will urge the shuttle piston 48 to the left to unseat the check valve 62 and open communication of the tilt cylinder chamber 61 and tilt-up return line 63 with the pump port 42.

Since the piston rod 25 extends into the tilt cylinder chamber 61 more fluid will be required in the chamber 55 to achieve tilt and trim-up movement than the return fluid from the chamber 61. This make-up fluid can be drawn through the line 66 by opening of the check valve 69.

When the trim cylinders 27 reach the end of their strokes, if tilt-up operation is desired, the system still is operated so as to drive the pump 39 to pressurize the port 41. Once the trim cylinders 27 reach the ends of their strokes, all fluid will be delivered to the tilt chamber 55 and the outboard motor 11 will tilt up rapidly. Once the tilt piston 59 reaches the end of its stroke, the relief valve 71 will open and preclude excess hydraulic pressure in the system.

Tilt or trim-down operation is achieved in the manner now to be described. The electric motor 37 is driven in the reverse direction from that previously described so as to drive the fluid pump 39 in a direction so that the port 42 acts as the pressure port and the port 41 acts as the return port. When this occurs, fluid will be delivered to the shuttle valve chamber 46 opening the check valve 62 and pressurizing the line 63. The pressure will rise in the chamber 61 so as to urge the tilt cylinder piston 56 in its lowering direction. This will occur until the swivel bracket 17 recontacts the piston rods 29 of the trim motors 27. Continued tilt-down operation will then cause the trim cylinder pistons 54 to be retracted and fluid will be driven out of the line 52 and back to the reservoir line 67.

During the tilt and trim-down movement, the shuttle piston 48 will be urged to the right and unseat the check valve 49 so as to permit exhaust of the fluid from the tilt cylinder chamber 55 through the line 51 and shuttle valve chamber 45 back to the pump port 41. No fluid make-up is normally required under this operation.

When the device reaches the end of its tilt and trim-down movement, pressure will rise in the line 45 and unseat the relief valve 72 to prevent damage.

To permit manual operation, a manual release valve 73 is provided between the conduit 63 and the conduits 52 and the return conduit 67. By opening the valve 73, the outboard motor 11 can be manually moved to its desired position.

The foregoing description of the hydraulic system may be considered to be conventional and, for that reason, further description of it is believed to be unnecessary. The invention, however, relates to the manner in which the reservoir 38 communicates with the return line 67 so as to preclude air from entering the system and this operation will now be described by particular reference to FIGS. 3 through 5.

As has already been described, the reservoir 38 is mounted on the mounting portion 35 and is adapted to contain a level of hydraulic fluid, shown by the line 74. The reservoir 38 is normally filled with some excess fluid above that required by the system to compensate for possible leakage. In addition, the area over the fluid line 74 is filled by an inert gas such as nitrogen 75 which is compressible and which will permit the level 74 to rise and raise and lower due to the make-up action required to compensate for the areas of piston rods 29 of the trim fluid motors 27 in their chambers 64 and 66 and the tilt cylinder piston rod 25 in its chamber 61, as aforenoted.

Figure 3:
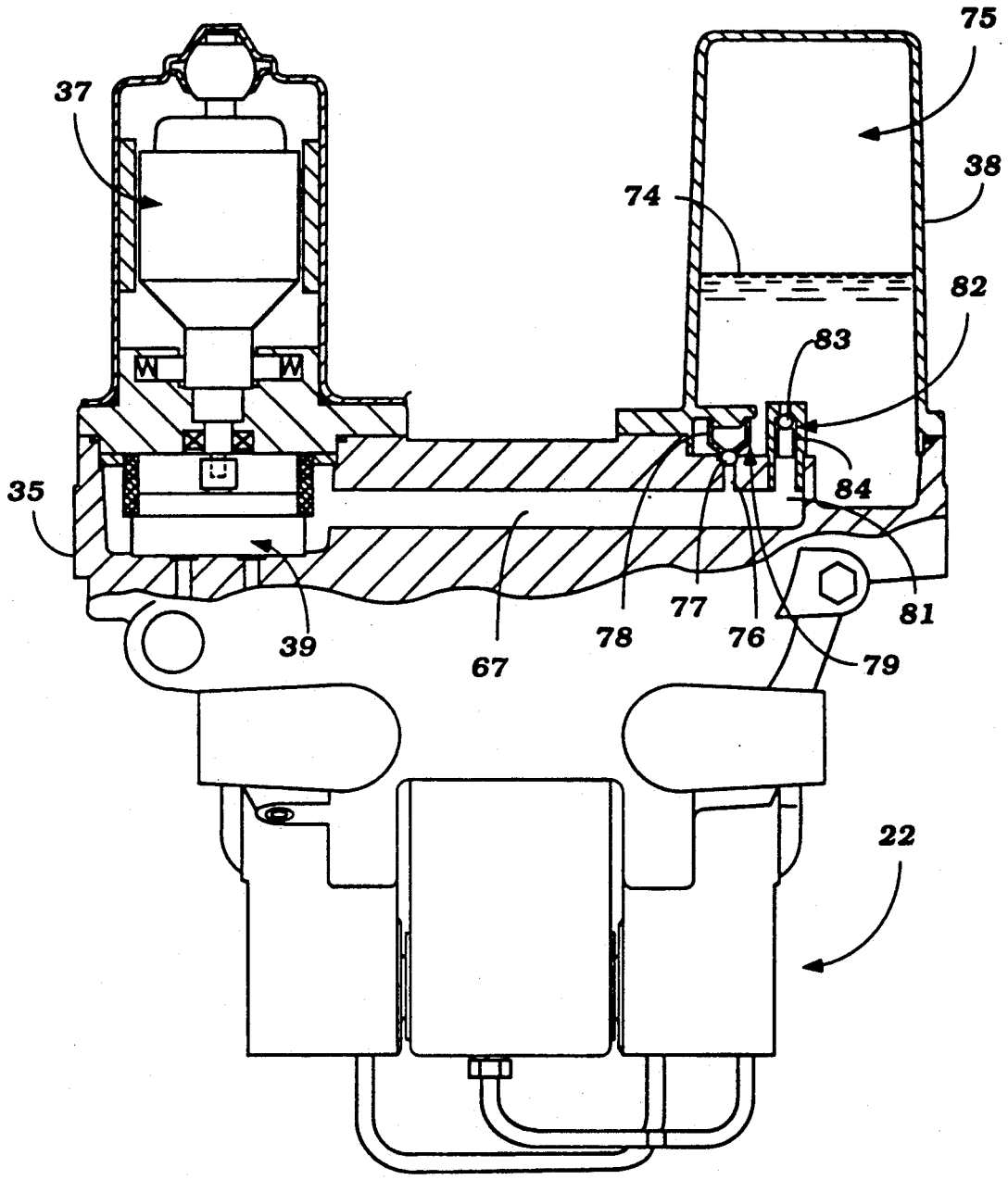
FIG. 3 is a view looking generally in the same direction as FIG. 2, with portions broken away to show the interrelationship between the hydraulic pump and the reservoir.
Figure 5:
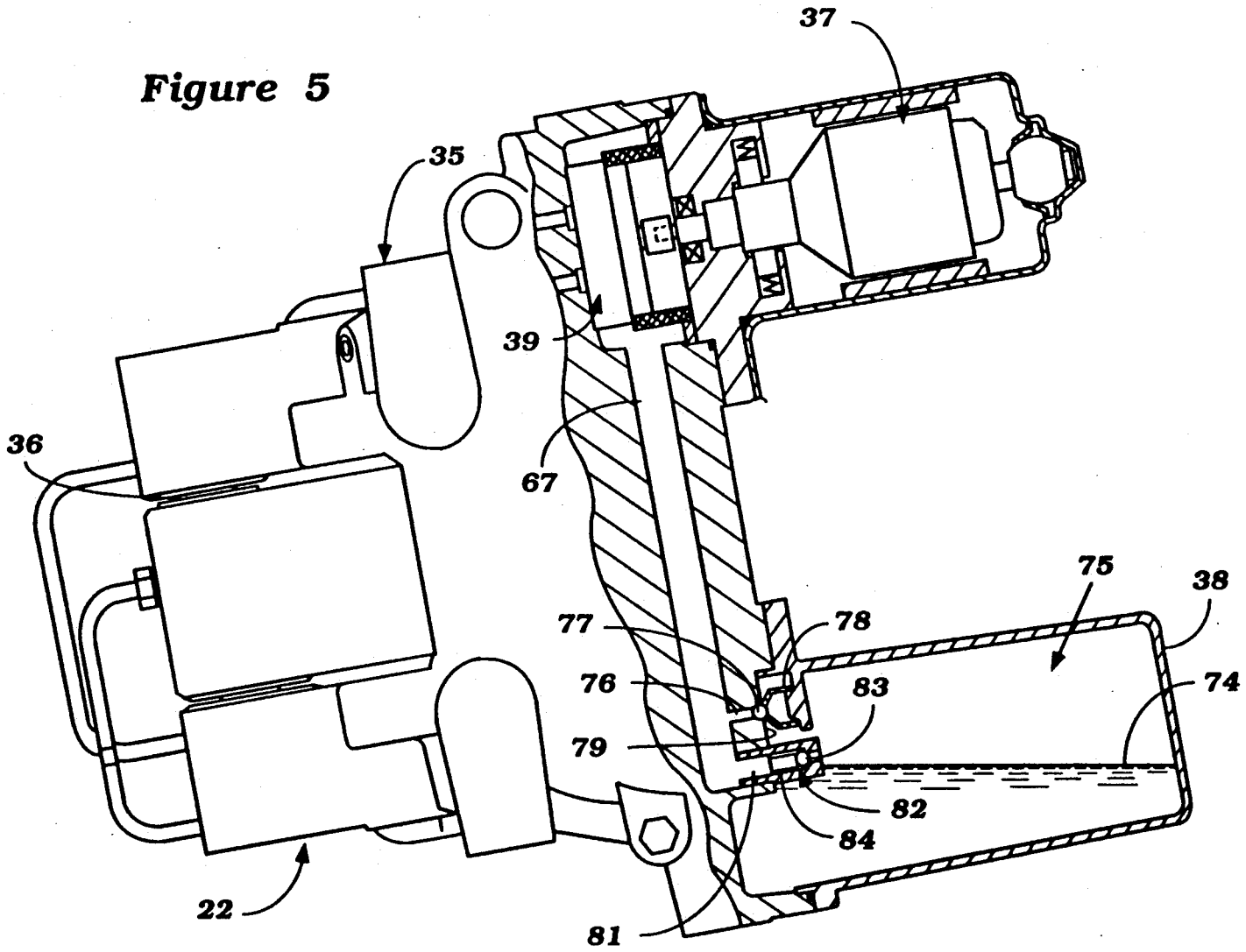
FIG. 5 is a view, in part similar to FIG. 3, and shows how the device operates to preclude air entering the system when the unit is displaced from its normal operative position so as to preclude air from entering the hydraulic circuitry.

Conventionally, the return line 67 has been an open line and, in the illustrated embodiment, it is shown as being formed integrally in the mounting portion 35. An open line is normally thought to be acceptable because of the vertical orientation of the reservoir under normal conditions as shown in FIG. 3. This permits the gas to fill the chamber 75 above the fluid level 74. However, frequently the unit either during shipment or when the outboard motor 11 is detached from the transom 21 may be laid on its side as shown in FIG. 5. In this condition, the gas chamber 75 could communicate with the line 67 and cause gas to enter into the fluid circuits as aforedescribed.

In accordance with the invention, a double acting check valve assembly is provided which consists of a return check valve, indictated generally by the reference numeral 76 and which is located in a passage 77 that extends from the return line 67 to the reservoir 35 and in which a return flow permitting check valve 78 held lightly and engagement with its seat by a spring 79 is provided. When fluid is being forced back to the reservoir 38, the check valve 78 will become unseated and fluid can then return to the reservoir 38 through the return passage 79..

When make-up fluid is being required, a make-up fluid line 81 in which a check valve assembly, indicated generally by the reference numeral 82 is provided will function. The check valve 82 includes a ball type valve 83 that is urged to a close position by a coil compression spring 84 and which operates to permit flow from the reservoir 38 to the return line 67 but not flow in the opposite direction.

Again, when the outboard motor is laid on its side as shown in FIG. 5, both the passages 81 and 77 will be uncovered but the check valves 76 and 83 will be held in position and, accordingly, no gas can enter the hydraulic circuit. As a result, the system will be well protected against the likelihood of air intrusion regardless of the orientation of the unit. However, the litely operating check valves 76 and 82 will easily permit fluid to flow from or to the reservoir 38 under normal pump operation.

From the foregoing description, it should be readily apparent to those skilled in the art that a very effective hydraulic system is disclosed for controlling the trim condition of a marine outboard drive while permitting a reservoir with gas above the liquid in it and which gas can not enter the hydraulic circuitry. In addition, the unit is mounted in such a way that the hydraulic system is protected by the components of the outboard drive and mounting and can be mounted outboard of the transom without fear of damage. Of course, the foregoing description is that of a preferred embodiment of the invention and various changes and modifications may be made without departing from the spirit and scope of the invention, as defined by the appended claims.

I claim:

1. A hydraulic arrangement for controlling a trim condition of a marine outboard drive comprised of a hydraulic unit adapted to be interposed between said outboard drive and an associated watercraft for controlling the trim of said outboard drive, said hydraulic unit having a pair of chambers between which fluid passes upon trim changes, a hydraulic reservoir adapted to contain a fluid for said hydraulic unit of a variable level in said reservoir and a gas above the level of fluid in said reservoir for accommodating the varying volumes of fluid in said reservoir, conduit means connecting said reservoir with said hydraulic unit for flow therebetween, and a pair of oppositely acting check valves in said conduit means for permitting fluid flow under pressure through said conduit means from said reservoir to said unit or flow from said unit to said reservoir while precluding gas flow from said reservoir to said hydraulic unit.

2. A hydraulic arrangement as set forth in claim 1 wherein the conduit means comprises a single conduit communicating with a pair of parallel passages each with a respective one of the check valves therein.

3. A hydraulic arrangement as set forth in claim 1 wherein the hydraulic unit displaces different volumes from its chambers in response to a given degree of movement.

4. A hydraulic arrangement as set forth in claim 3 wherein the hydraulic unit comprises a reciprocating motor.

5. A hydraulic arrangement as set forth in claim 4 wherein the reciprocating motor comprises a piston and cylinder unit with a piston rod extending through one of the chambers for providing the different volumes of fluid change.

6. A hydraulic arrangement as set forth in claim 5 wherein the conduit means comprises a single conduit communicating with a pair of parallel passages each with a respective one of the check valves therein.

7. A hydraulic arrangement as set forth in claim 1 wherein the hydraulic arrangement further includes a reversible hydraulic pump for selectively pressurizing the chambers of the hydraulic unit.

8. A hydraulic arrangement as set forth in claim 7 wherein the hydraulic unit displaces different volumes from its chambers in response to a given degree of movement.

9. A hydraulic arrangement as set forth in claim 8 wherein the hydraulic unit comprises a reciprocating motor.

10. A hydraulic arrangement as set forth in claim 9 wherein the reciprocating motor comprises a piston and cylinder unit with a piston rod extending through one of the chambers for providing the different volumes of fluid change.

11. A hydraulic arrangement as set forth in claim 10 wherein the conduit means comprises a single conduit communicating with a pair of parallel passages each with a respective one of the check valves therein.

12. A hydraulic arrangement as set forth in claim 7 wherein there are a pair of hydraulic units each interposed between the outboard drive and the associated watercraft.

13. A hydraulic arrangement as set forth in claim 12 wherein one of the hydraulic units achieves trim adjustment and the other of the hydraulic units provides tilt-up operation.

14. A hydraulic arrangement as set forth in claim 13 wherein the hydraulic units displace different volumes from their chambers in response to a given degree of movement.

15. A hydraulic arrangement as set forth in claim 14 wherein each hydraulic unit comprises a reciprocating motor.

16. A hydraulic arrangement as set forth in claim 15 wherein each reciprocating motor comprises a piston and cylinder unit with a piston rod extending through one of the chambers for providing the different volumes of fluid change.

17. A hydraulic arrangement as set forth in claim 16 wherein the conduit means comprises a single conduit communicating with a pair of parallel passages each with a respective one of the check valves therein.

18. A hydraulic arrangement as set forth in claim 13 wherein there is a third hydraulic unit and two of the hydraulic units achieve trim adjustment.

19. A hydraulic arrangement as set forth in claim 18 wherein each hydraulic unit displaces different volumes from its chambers in response to a given degree of movement.

20. A hydraulic arrangement as set forth in claim 19 wherein each hydraulic unit comprises a reciprocating motor.

21. A hydraulic arrangement as set forth in claim 20 wherein each reciprocating motor comprises a piston and cylinder unit with a piston rod extending through one of the chambers for providing the different volumes of fluid change.

22. A hydraulic arrangement as set forth in claim 21 wherein the conduit means comprises a single conduit communicating with a pair of parallel passages each with a respective one of the check valves therein.

23. A hydraulic arrangement as set forth in claim 22 further including a pair of spaced apart transom brackets adapted to be affixed to a hull of the associated watercraft and which support the outboard drive for trim movement, said hydraulic unit being disposed between said brackets.

24. A hydraulic arrangement as set forth in claim 23 wherein each of the brackets having a generally angular shape with a first leg affixed to the watercraft hull and the hydraulic unit being positioned between the other legs thereof with the tilt unit being disposed centrally and the trim units being disposed on the sides of the tilt unit, the hydraulic pump being disposed between one of the brackets and the tilt cylinder and the hydraulic reservoir being positioned between the other of the brackets and the tilt cylinder.

25. A hydraulically operated tilt and trim unit for a marine outboard drive comprised of a pair of spaced apart transom brackets adapted to be affixed to a transom of an associated watercraft and having leg portions extending rearwardly therefrom, a marine outboard drive supported for pivotal movement by said brackets and positioned therebetween, a mounting assembly affixed between said brackets and carrying a pair of spaced apart trim cylinders have pistons engaged with said outboard drive for adjusting the trim thereof, a tilt cylinder having a first portion pivotally connected between said brackets and a second portion pivotally connected to said outboard drive for effecting tilt movement thereof between said trim cylinders, and a hydraulic pump assembly positioned between one of said brackets and said tilt cylinder.

26. A hydraulically operated tilt and trim unit as set forth in claim 25 further including a reversible electric motor for driving said hydraulic pump assembly and mounted between said one bracket and said tilt cylinder.

27. A hydraulically operated tilt and trim unit as set forth in claim 26 further including a hydraulic reservoir positioned between the other of said brackets and said tilt cylinder.

28. A hydraulic arrangement for controlling a trim condition of a marine outboard drive comprised of a hydraulic unit adapted to be interposed between said outboard drive and an associated watercraft for controlling the trim of said outboard drive, said hydraulic unit having a pair of chambers between which fluid passes upon trim changes, a hydraulic reservoir adapted to contain a fluid for said hydraulic unit of a variable level in said reservoir and a gas above the level of fluid in said reservoir for accommodating the varying volumes of fluid in said reservoir, a single conduit connecting said reservoir with said hydraulic unit for flow therebetween, and a pair of oppositely acting check valves connecting said reservoir to said conduit for permitting fluid flow under pressure through said conduit from said reservoir to said unit or from said unit to said reservoir while precluding gas flow from said reservoir to said hydraulic unit.

29. A hydraulic arrangement as set forth in claim 28 wherein the hydraulic arrangement further includes a reversible hydraulic pump for selectively pressurizing the chambers of the hydraulic unit said single conduit connecting said reservoir with said pump for supplying fluid to said pump or receiving fluid under pressure to said pump.

30. A hydraulic arrangement as set forth in claim 29 wherein the hydraulic unit displaced different volumes from its chambers in response to a given degree of movement.

31. A hydraulic arrangement as set forth in claim 30 wherein the hydraulic unit comprises a reciprocating motor.

32. A hydraulic arrangement as set forth in claim 31 wherein the reciprocating motor comprises a piston and cylinder unit with a piston rod extending through one of the chambers for pivoting the different volumes of fluid change.

* * * * *